US007364212B1

(12) United States Patent
Fan

(10) Patent No.: US 7,364,212 B1
(45) Date of Patent: Apr. 29, 2008

(54) DOOR LOCK

(75) Inventor: Fang-Chang Fan, Chia-Yi (TW)

(73) Assignee: Eversafety Precision Industry (Tianjin) Co., Ltd., Tianjin (CN)

( * ) Notice: Subject to any disclaimer, the term of this patent is extended or adjusted under 35 U.S.C. 154(b) by 0 days.

(21) Appl. No.: 11/605,001

(22) Filed: Nov. 28, 2006

(51) Int. Cl.
*E05B 3/00* (2006.01)

(52) U.S. Cl. ..... 292/336.3; 70/107; 292/33

(58) Field of Classification Search ..... 292/336.3, 292/350, 34, 37, 33; 70/107
See application file for complete search history.

(56) References Cited

U.S. PATENT DOCUMENTS 2,094,982 A * 10/1937 Gerard ..... 292/347
4,418,552 A * 12/1983 Nolin ..... 70/107
5,881,585 A * 3/1999 Kang ..... 70/107
6,981,726 B2 * 1/2006 Huang ..... 292/350

* cited by examiner

*Primary Examiner*—Gary Estremsky
(74) *Attorney, Agent, or Firm*—William E. Pelton, Esq.; Cooper & Dunham LLP

(57) ABSTRACT

A door lock includes a panel, a base plate, and a middle plate. A handle and a thumb-turn are rotatably mounted on the panel, wherein the thumb-turn has a first spindle mounted on the middle plate and engaged with the thumb-turn, an upper cam mounted on a rear end of the first spindle. The handle has a second spindle mounted on the middle plate and engaged with the handle, and a lower cam with two shoulders mounted on a rear end of the second spindle. A linking sheet is provided between the middle plate and the base plate and has two legs each having a foot pushed by the respective shoulder and an upper end pushing the upper cam. Two slots are defined in the legs, and two springs are received in the longitudinal slots and are pressed between first stops and second stops.

9 Claims, 4 Drawing Sheets

DOOR LOCK

BACKGROUND OF THE INVENTION

1. Field of the Invention

The present invention relates to a lock, and more particularly to a lock which can release a bolt while a handle is turned.

2. Description of Related Art

A conventional door lock generally includes a latch bolt and a locking bolt. The latch bolt can be operated with a handle or knob, and the locking bolt can be operated with a thumb-turn. In the conventional door lock, the latch bolt and the locking bolt are operated independently. Namely, the thumb-turn should be operated to release the locking bolt before the handle or knob is operated to release the latch bolt.

It is often impossible for kids to understand the relationship between the latch bolt and the locking bolt, so they can not correctly release the locking bolt or may delay to open the door in an emergency such as fire, earthquake etc.

Therefore, the invention provides a door lock to mitigate or obviate the aforementioned problems.

SUMMARY OF THE INVENTION

The main objective of the present invention to provide a door lock of which a handle and a thumb-turn can be operatively connected together for releasing a locking bolt while a latch bolt is released.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
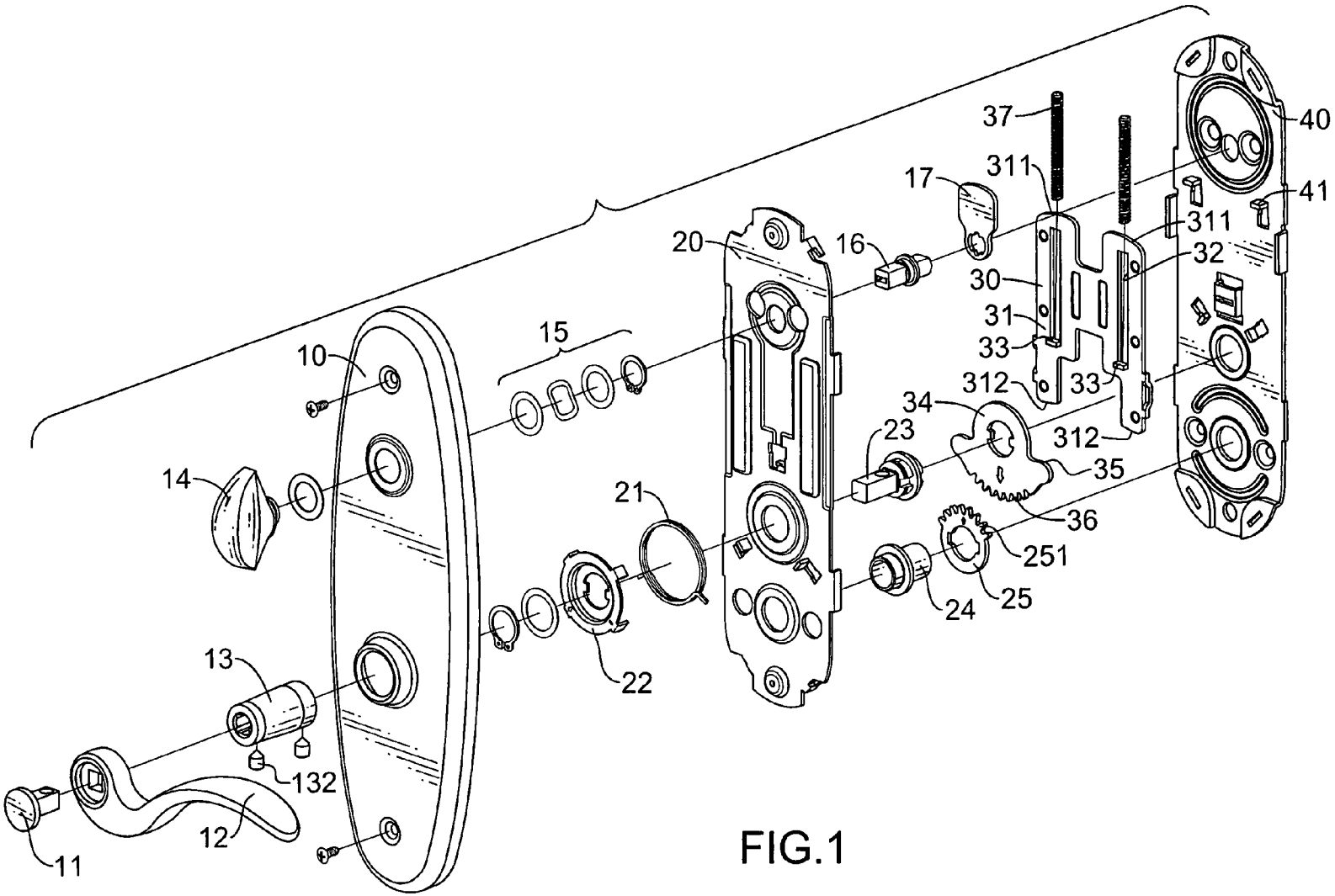
FIG. 1 is an exploded perspective view of a door lock in accordance with the present invention.
Figure 3:
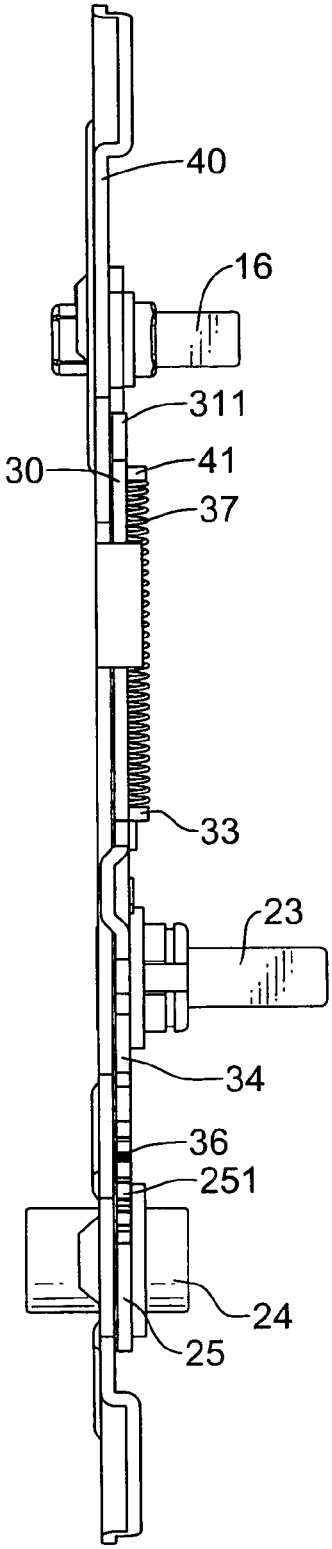
FIG. 3 is a side view of the door lock in FIG. 1.
Figure 2:
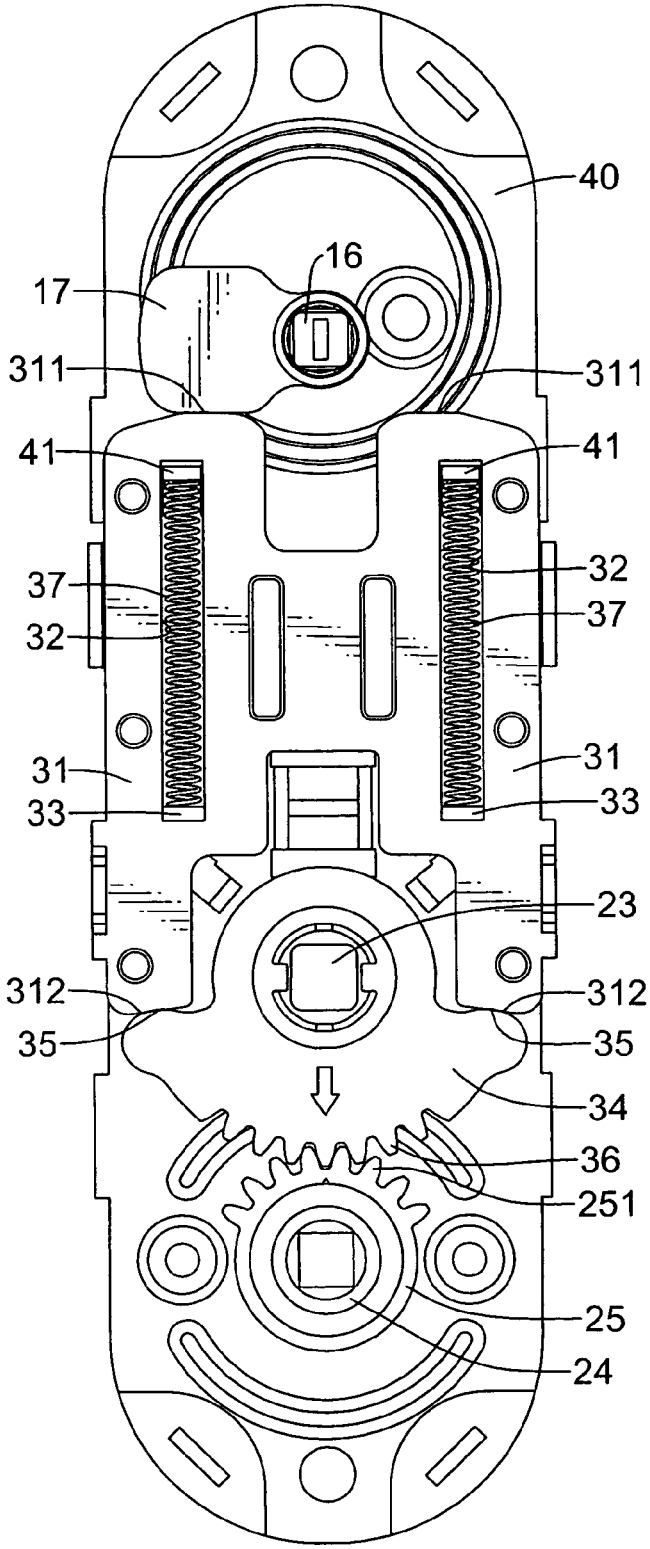
FIG. 2 is a front view of the door lock in FIG. 1.

With reference to FIGS. 1-3, a door lock in accordance with the present invention comprises a panel (10), a base plate (40), and a middle plate (20) mounted between the panel (10) and the base plate (40).

The panel (10) has a handle barrel (13) and a thumb-turn (14) rotatably mounted thereon. A handle (12) is mounted on the handle barrel (13) with a pin (11). The handle (12) is generally used for operating a latch bolt, and the thumb-turn (14) is generally used for operating a locking bolt.

The thumb-turn (14) is inserted in the panel (10) and is engaged with a first spindle (16). The first spindle (16) is mounted on the middle plate (20). A plurality of washers (15) is provided on the thumb-turn (14) and is located between the panel (10) and the middle plate (20). An upper cam (17) is mounted on a rear end of the first spindle (16) and is located between the middle plate (20) and the base plate (40).

A second spindle (23) is mounted on the middle plat (20) and extends into the handle barrel (13). A disk (22) is provided on the second spindle (23) and is located between the panel (10) and the middle plate (20), so that the second spindle (23) and the disk (22) will be rotated with the handle (12). A torsion spring (21) is provided on the disk (22) for automatically turning back the handle (12).

A lower cam (34) is mounted at a rear end of the second spindle (23). The lower cam (34) has two shoulders (35) respectively formed at two opposite sides thereof, and multiple first teeth (36) formed at a lower side thereof. A driven axle (24) is rotatably mounted on the middle plate (20), and a gear (25) is mounted on the driven axle (24) and has second teeth (251) engaged with the first teeth (36) of the lower cam (34). Thus, when the lower cam (34) is rotated, the gear (25) and the driven axle (24) are rotated by means of the engagement of the teeth (36, 251). A distance from the center of the lower cam (34) to the first teeth (36) is significantly larger than a distance from the center of the gear (25) to the second teeth (251), so that even a small rotating angle of the lower cam (34) can make the gear (25) a large rotating angle to unlock the door lock. Thus, the handle (12) can be designed with a small restricted rotatable angle for releasing the latch bolt. It is advantageous to prevent elders from overexerting to turn the handle (12) and tumbling.

A linking sheet (30) is movable provided between the middle plate (20) and the base plate (40). The linking sheet (30) has two legs (31) each having a foot (312) which can contact with one of the shoulders (35). Each of the legs (31) has a longitudinal slot (32) defined therein, and a first stop (33) formed at a lower end of the longitudinal slot (32). Two second stops (41) are formed on the base plate (40) and respectively extend into the longitudinal slot (32). Two springs (37) are respectively received in the longitudinal slots (32) and are pressed between the first stops (33) and second stops (41). The linking sheet (30) further has two upper ends (311) connected to the upper cam (17).

Therefore, the thumb-turn (14) can be operated together with the handle (12) with the transmission of the linking sheet (30).

Figure 4:
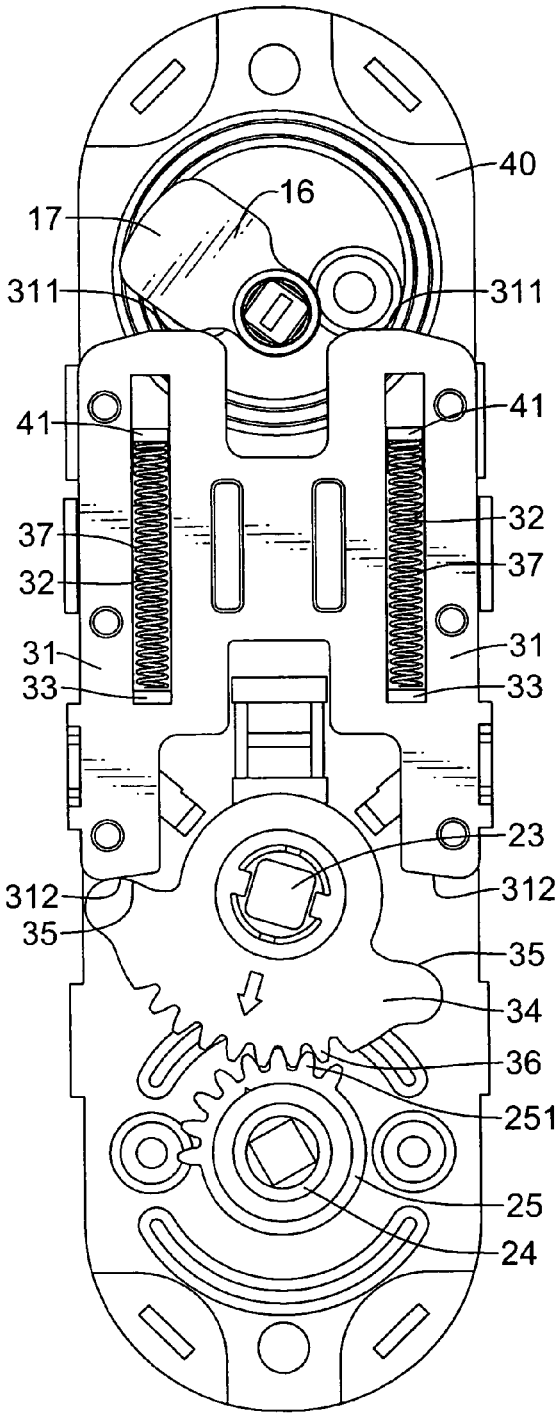
FIG. 4 is an operational front view of the door lock in FIG. 2 showing the door lock in a first status.
Figure 5:
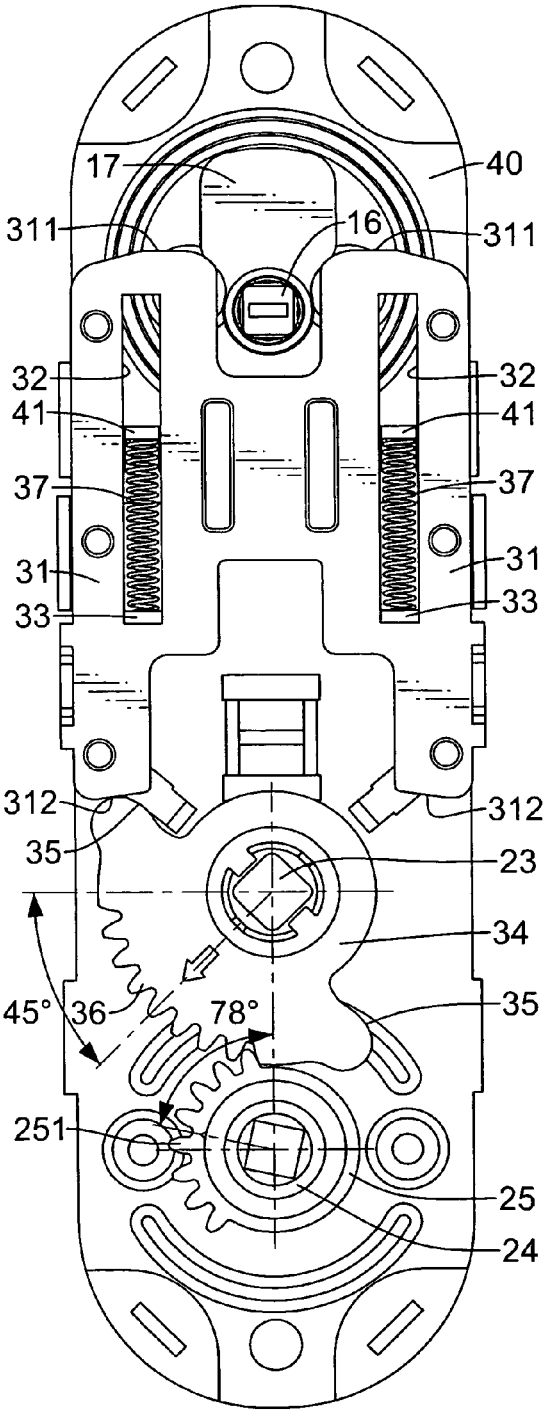
FIG. 5 is an operational front view of the door lock in FIG. 2 showing the door lock in a second status.

With reference to FIGS. 1, 4 and 5, when the handle (12) is rotated, the disk (22) and second spindle (23) are rotated to turn the lower cam (34). Then, one of the shoulders (35) pushes the linking sheet (30) upwards while the springs (37) are compressed by the first stops (33) being moved upwards. At the same time, the upper cam (17) is pushed by one of the upper ends (311) to rotate, so that the first spindle (16) is rotated for releasing the locking bolt. When the handle (12) is released, the disk (22) is rotated back under the force provided by the torsion spring (21), so the handle (12) can be turned back to the original position.

Figure 6:
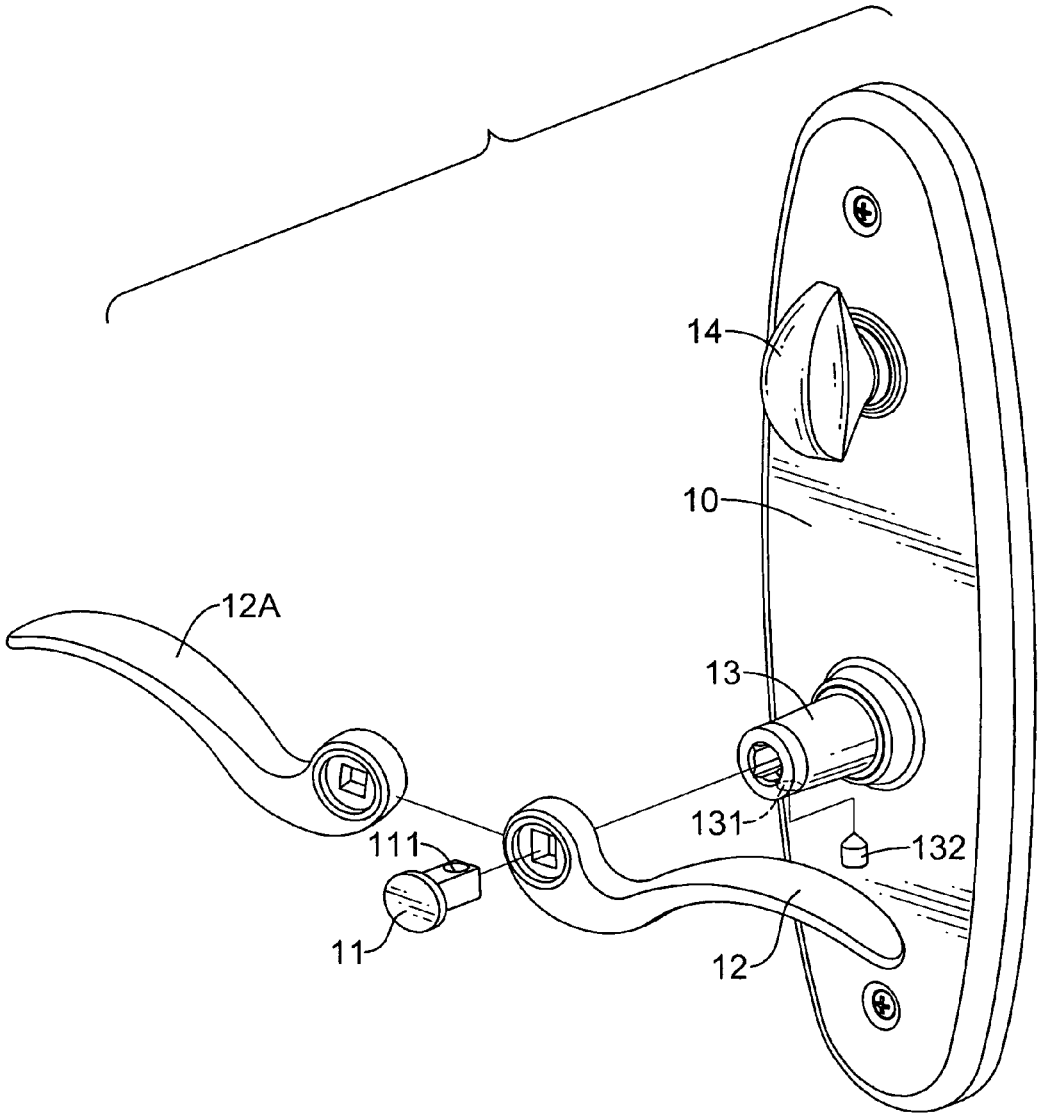
FIG. 6 is an exploded perspective view of the door lock in FIG. 1 being replaced with another handle.

With reference to FIG. 6, the handle (12) is installed on the handle barrel (13) by the pin (11). The pin (11) has a threaded hole (111), and the handle barrel (13) has an aperture (131) in alignment with the threaded hole (111). A screw (132) is inserted into the aperture (131) and is screwed into the threaded hole (111) to fasten the handle (12) on the handle barrel (13).

For replacing the handle (12) with another handle (12A) with a different direction as shown in FIG. 6, it is very easy to disengage/engage the screw (132) from/into the handle barrel (13) to detach/attach the handle (12,12A).

Therefore, the present invention has the following advantages:

1. The thumb-turn (14) can be turned while the handle (12) is turned, so it is very easy and convenient to release the locking bolt, and even a kid who is unable to operate the thumb-turn (14) can rapidly unlock the door lock in an emergency condition.

2. It is safe for an elder to open the door by turning the handle (12) with a very small angle.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A door lock comprising:

a panel;

a base plate;

a middle plate mounted between the panel and base plate;

a handle and a thumb-turn rotatably mounted on the panel, wherein the thumb-turn has a first spindle mounted on the middle plate and engaged with the thumb-turn, an upper cam is mounted on a rear end of the first spindle, the handle has a second spindle mounted on the middle plate and engaging the handle, and a lower cam that has two shoulders formed respectively at two sides of the lower cam, is mounted on a rear end of the second spindle, wherein the lower cam further has multiple first teeth formed at a lower side, a driven axle is mounted on the middle plate, and a gear having a center is mounted on the driven axle and has multiple second teeth engaging the first teeth, wherein a distance from a center of the lower cam to the first teeth is significantly larger than a distance from the center of the gear to the second teeth; and a linking sheet movably mounted between the middle plate and the base plate, the linking sheet comprising two legs, each leg having a foot that can be pushed by one of the shoulders, and each leg further having an upper end that can push the upper cam to turn, two longitudinal slots defined respectively in the legs, two first stops formed respectively at lower ends of the longitudinal slots and two second stops formed on the base plate and protruding respectively into the longitudinal slots, and two springs mounted respectively in the longitudinal slots and pressed between the first stops and second stops.

2. The door lock as claimed in claim 1, wherein the panel has a handle barrel rotatably mounted thereon, the handle is mounted on the handle barrel by a pin.

3. The door lock as claimed in claim 1, wherein the pin has a threaded hole, the handle barrel has an aperture in alignment with the threaded hole, and a screw is inserted through the aperture and screwed into the threaded hole to fasten the handle.

4. A door lock comprising:

a panel;

a base plate;

a middle plate mounted between the panel and base plate;

a handle and a thumb-turn rotatably mounted on the panel, wherein the thumb-turn has a first spindle mounted on the middle plate and engaging the thumb-turn, an upper cam is mounted on a rear end of the first spindle, the handle has a second spindle mounted on the middle plate and engaging the handle, and a lower cam that has two shoulders formed respectively at two sides of the lower cam, is mounted on a rear end of the second spindle;

a linking sheet movably mounted between the middle plate and the base plate, the linking sheet comprising two legs, each leg having a foot that can be pushed by one of the shoulders, and each leg further having an upper end that can push the upper cam to turn, two longitudinal slots defined respectively in the legs, two first stops formed respectively at lower ends of the longitudinal slots and two second stops formed on the base plate and protruding respectively into the longitudinal slots, and two springs mounted respectively in the longitudinal slots and pressed between the first stops and second stops; and a disk mounted on the second spindle and located between the panel and middle plate, and a torsion spring mounted on the disk.

5. The door lock as claimed in claim 4, wherein the lower cam further has multiple first teeth formed at a lower side, a driven axle is mounted on the middle plate, and a gear having a center is mounted on the driven axle and having multiple second teeth engaged with the first teeth, wherein a distance from a center of the lower cam to the first teeth is significantly larger than a distance from the center of the gear to the second teeth.

6. The door lock as claimed in claim 5, wherein the panel has a handle barrel rotatably mounted on the panel, and the handle is mounted on the handle barrel by a pin.

7. The door lock as claimed in claim 6, wherein the pin has a threaded hole, the handle barrel has an aperture in alignment with the threaded hole, and a screw is inserted through the aperture and screwed into the threaded hole to fasten the handle.

8. The door lock as claimed in claim 4, wherein the panel has a handle barrel rotatably mounted on the barrel, and the handle is mounted on the handle barrel by a pin.

9. The door lock as claimed in claim 4, wherein the pin has a threaded hole, the handle barrel has an aperture in alignment with the threaded hole, and a screw is inserted through the aperture and screwed into the threaded hole to fasten the handle.

* * * * *